US009771247B2

(12) United States Patent
Yi et al.

(10) Patent No.: US 9,771,247 B2
(45) Date of Patent: Sep. 26, 2017

(54) CYLINDER-DRIVEN LIFTING MECHANISM OF COMPACTION MACHINE AND COMPACTION MACHINE

(71) Applicants: HUNAN SANY INTELLIGENT CONTROL EQUIPMENT CO., LTD, Changsha, Hunan (CN); SANY HEAVY INDUSTRY CO., LTD, Beijing (CN)

(72) Inventors: Xiaogang Yi, Hunan (CN); Zuoliang Zhang, Hunan (CN); Dong Li, Hunan (CN); Zhekui Quan, Hunan (CN)

(73) Assignees: HUNAN SANY INTELLIGENT CONTROL EQUIPMENT CO., LTD., Changsha, Hunan (CN); SANY HEAVY INDUSTRY CO., LTD, Beijing (CN)

( * ) Notice: Subject to any disclaimer, the term of this patent is extended or adjusted under 35 U.S.C. 154(b) by 641 days.

(21) Appl. No.: 14/277,244

(22) Filed: May 14, 2014

(65) Prior Publication Data

US 2014/0246635 A1 Sep. 4, 2014

Related U.S. Application Data

(63) Continuation of application No. PCT/CN2013/087034, filed on Nov. 13, 2013.

(30) Foreign Application Priority Data

Nov. 22, 2012 (CN) ..... 2012 1 04787233

(51) Int. Cl.
*B66D 3/20* (2006.01)
*E02D 3/046* (2006.01)

(52) U.S. Cl.
CPC ..... *B66D 3/20* (2013.01); *E02D 3/046* (2013.01)

(58) Field of Classification Search
CPC ... B66D 3/20; B66D 5/16; B66D 1/36; B66D 1/38; B66D 1/44; B66D 2700/028; E02D 3/046

(Continued)

(56) References Cited

U.S. PATENT DOCUMENTS 3,534,867 A * 10/1970 Ghysels ..... B66C 23/701 212/264
3,591,022 A * 7/1971 Polyakov ..... B66C 13/02 212/309

(Continued)

*Primary Examiner* — Emmanuel M Marcelo
(74) *Attorney, Agent, or Firm* — Tim Tingkang Xia, Esq.; Locke Lord LLP

(57) ABSTRACT

In one aspect of the disclosure, a cylinder-driven lifting mechanism of a compaction machine includes a cylinder having a first end and a second end, a fixed pulley set, a movable pulley set, a rope having a head end, and a tail end configured to connect a compaction hammer. The first end of the cylinder is connected to a vehicle body of the compaction machine and the second end of the cylinder is connected to the movable pulley set. The rope is wound on the fixed pulley set and the movable pulley set and is then connected to the compaction hammer. When the cylinder performs extension and refraction movement, the movable pulley set moves with the cylinder, the distance between the movable pulley set and the fixed pulley set increases or decreases, and the compaction hammer connected to the tail end of the rope is lifted up or dropped respectively.

20 Claims, 9 Drawing Sheets

(58) Field of Classification Search
USPC ..... 254/393
See application file for complete search history.

(56) References Cited

U.S. PATENT DOCUMENTS

| | | | | | |
|---|---|---|---|---|---|
| 4,168,053 | A * | 9/1979 | Boenninghaus | E02D 9/02 | 254/266 |
| 4,688,764 | A * | 8/1987 | Nayler | B66C 13/02 | 254/277 |
| 5,209,361 | A * | 5/1993 | Grubb, Jr. | B65F 1/125 | 212/250 |
| 6,061,933 | A * | 5/2000 | Rogge | E02F 3/967 | 173/112 |
| 6,926,260 | B1 * | 8/2005 | De Groot | B66D 3/043 | 254/277 |
| 7,389,973 | B1 * | 6/2008 | Chou | B66D 1/50 | 254/277 |
| 8,312,908 | B2 * | 11/2012 | Hinc | B29D 30/1635 | 156/394.1 |
| 2009/0208296 | A1 * | 8/2009 | Cook | E02D 3/02 | 405/271 |
| 2012/0217063 | A1 * | 8/2012 | Roodenburg | B66C 13/02 | 175/5 |

* cited by examiner

CYLINDER-DRIVEN LIFTING MECHANISM OF COMPACTION MACHINE AND COMPACTION MACHINE

CROSS-REFERENCE TO RELATED APPLICATIONS

This application is a continuation application of International Application No. PCT/CN2013/087034, filed on Nov. 13, 2013, entitled "CYLINDER-DRIVEN LIFTING MECHANISM OF COMPACTION MACHINE AND COMPACTION MACHINE", by Xiaogang Y I, Zuoliang ZHANG, Dong L I, and Zhekui QUAN, which itself claims priority of Chinese Patent Application No. 201210478723.3, filed with the Chinese Patent Office on Nov. 22, 2012, entitled "CYLINDER-DRIVEN LIFTING MECHANISM OF COMPACTION MACHINE AND COMPACTION MACHINE", by Xiaogang Y I, Zuoliang ZHANG, Dong L I, and Zhekui QUAN, the disclosures of which are incorporated herein in their entireties by reference.

FIELD OF THE INVENTION

The present disclosure mainly relates to the field of construction machinery, and more particularly to a cylinder-driven lifting mechanism of a compaction machine and a compaction machine containing the cylinder-driven lifting mechanism of the compaction machine.

BACKGROUND OF THE INVENTION

A compaction machine is a kind of construction machinery used to impact and compact construction materials or foundations. The compaction machine is widely used in construction operations of industrial and civil buildings, warehouses, yards, docks, airports, foundations of roads and railways, artificial islands, and so on. A lifting mechanism is an important component of a compaction machine. After the lifting mechanism lifts a compaction hammer of the compaction machine to certain height, and releases the compaction hammer to let the compaction hammer fall freely. The free fall of the compaction hammer (a) applies a strong impact force and vibrations to a soil or other construction material surface or a foundation, (b) compacts the soil or other construction materials, (c) decreases compressibility of the soil or other construction materials, (d) improves evenness of the surface of the soil or other construction materials, and (e) reduces future differential settlement.

The lifting mechanism of a compaction machine is generally a winch-type lifting mechanism. The winch-type lifting mechanism includes structures such as a motor (an electric motor or a hydraulic motor), a speed reducer, a clutch, a spool, and a brake. The winch-type lifting mechanism needs to have high braking capacity, and has strict requirements on the clutch regarding shock resistance, friction, and resistance to high temperatures. These requirements greatly increase production and manufacturing costs. Further, the control system of the winch-type lifting mechanism is very complicated, and very difficult to manufacture and maintain, and very difficult for operators to adjust and maintain on a daily basis. As the compaction machine is increasingly frequently used, a ramming process of the compaction hammer frequently impacts the winch-type lifting mechanism. These impacts will likely cause it to fail, cause severe damages to the components, such as the motor, the clutch, and the brake due to fatigue, and increase the maintenance costs of the compaction machine.

Additionally, the compaction machine works in a special environment. During ramming of the compaction hammer, the spool rotates at a high speed of 10 r/s. When a steel wire rope is released from the spool, a certain inclination angle may be formed between the steel wire rope and the axis of the spool. It may cause the spool to shake. In certain extreme cases, such shake may cause internal oil leakage, and reduce reliability and safety during use.

As the compaction machine is increasingly required on construction sites, requirements on performance of the compaction machine become higher and stricter. In view of the defects of existing winch-type lifting mechanism having high production, manufacturing, and maintenance costs, it is desirable to have a lifting mechanism of a compaction machine with low production, manufacturing, and maintenance costs, high reliability, and small in size, to meet increasing demands for the compaction machine from users.

Therefore, heretofore unaddressed needs exist in the art to address the aforementioned deficiencies and inadequacies.

SUMMARY OF THE INVENTION

In one aspect, the present disclosure relates to a cylinder-driven lifting mechanism of a compaction machine. In certain embodiments, the cylinder-driven lifting mechanism of the compaction machine includes: (a) a cylinder, (b) a fixed pulley set, (c) a movable pulley set, and (d) a rope. The cylinder has a first end and a second end. The first end of the cylinder is connected to a vehicle body of the compaction machine, and the second end of the cylinder is connected to the movable pulley set. The rope has a head end, and a tail end. The tail end of the rope is connected a compaction hammer. The rope is wound on the fixed pulley set and the movable pulley set and is then connected to the compaction hammer. The cylinder is configured to perform extension and retraction movements. When the cylinder performs extension and retraction movements, the movable pulley set moves with the cylinder. The distance between the movable pulley set and the fixed pulley set increases or decreases accordingly, and then, the compaction hammer connected to the tail end of the rope is lifted up or dropped respectively.

In certain embodiments, the lifting mechanism of the compaction machine may further include a jib head guide pulley. The jib head guide pulley is positioned on a jib of the compaction machine. The rope is wound upwards on the jib head guide pulley, and then turned downwards to connect to the compaction hammer.

In one embodiment, the number of fixed pulleys of the fixed pulley set and the number of movable pulleys of the movable pulley set may be both X. Here X is an integer greater than 1. The head end of the rope is fixedly disposed, and the rope is wound on the fixed pulleys and the movable pulleys alternately, and then turned upwards to go through the jib head guide pulley after being wound on the last movable pulley. In another embodiment, the number of fixed pulleys of the fixed pulley set may be Y, and the number of movable pulleys of the movable pulley set may be Y+1. Here Y is an integer greater than 1. The head end of the rope is fixedly disposed, and the rope is wound on the first movable pulley, is then wound on the fixed pulleys and movable pulleys alternately, and turned upwards to go through the jib head guide pulley after being wound on the last movable pulley.

In certain embodiments, the movable pulleys of the movable pulley set may be all positioned on a mounting shaft, and rotate about an axis of the mounting shaft. The mounting shaft is mounted on a mounting support frame. The second end of the cylinder is connected to the mounting support frame.

In one embodiment, the jib of the compaction machine may be a box-like structure. In another embodiment, the jib of the compaction machine may be a truss structure. The first end of the cylinder is positioned on the jib, and the cylinder is positioned to be in parallel with the jib. A support is mounted on the jib, and the fixed pulley set is mounted on the support.

In certain embodiments, the lifting mechanism of the compaction machine may further include a spool. The spool is rotatably mounted on the vehicle body. The head end of the rope is fixed on the spool. A part of the rope is retractably wound on the spool.

In certain embodiments, the lifting mechanism of the compaction machine may further include 2 spools. In one embodiment, there is only one rope for a single-rope releasing state. The head end of the rope is connected to one of the 2 spools, and the tail end of the rope is connected to the compaction hammer. In another embodiment, there are two ropes for a dual-rope releasing state. The head ends of the two ropes are each connected to one spool, and the tail ends of the two ropes are both connected to the compaction hammer. In certain embodiments, the movable pulley set is connected to only one cylinder.

In one embodiment, the lifting mechanism of the compaction machine may have a first oil-adding passage. The first oil-adding passage is positioned outside of a cylinder barrel of the cylinder. The first oil-adding passage is connected to a rodless chamber and a rod chamber of the cylinder. In a first state, when a piston rod of the cylinder extends, hydraulic oil enters from the rod chamber through the first oil-adding passage into the rodless chamber, and the compaction hammer is dropped. In a second state, when the piston rod of the cylinder retracts, the first oil-adding passage is closed, and the compaction hammer is lifted up. In certain embodiments, the first oil-adding passage may have a first hydraulically controlled cartridge valve. The first hydraulically controlled cartridge valve includes: (a) a first port connected to the rodless chamber, (b) a second port connected to the rod chamber, and (c) a control port connected to a first control oil passage. The first control oil passage releases pressurized oil in the first state and the pressurized oil is pumped into the first control oil passage in the second state. In certain embodiments, the lifting mechanism of the compaction machine may include multiple first oil-adding passages. These first oil-adding passages are mounted in parallel on an outer wall of the cylinder, and configured to connect the rodless chamber and the rod chamber.

In certain embodiments, the lifting mechanism of the compaction machine may further include a second oil-adding passage. The second oil-adding passage is positioned in a piston of the cylinder. The second oil-adding passage connects to a rodless chamber at one end of the piston and a rod chamber at the other end of the piston. In a first state, when the piston rod of the cylinder extends, hydraulic oil enters from the rod chamber through the second oil-adding passage into the rodless chamber such that the compaction hammer is dropped. In a second state, when the piston rod of the cylinder retracts, the second oil-adding passage is closed, and the compaction hammer is lifted up.

In certain embodiments, the second oil-adding passage may have a second hydraulically controlled cartridge valve. The second hydraulically controlled cartridge valve has (a) a first port connected to the rodless chamber, (b) a second port connected to the rod chamber, and (c) a control port connected to a second control oil passage. The second control oil passage is positioned in the piston rod. In the first state, the second control oil passage releases pressurized oil, and in the second state, pressurized oil is pumped into the second control oil passage. In certain embodiments, a first oil input passage may be further placed in the piston rod of the cylinder. The first oil input passage is in communication with an oil passage between the second port of the second hydraulically controlled cartridge valve and the rod chamber. The outer wall of the cylinder barrel of the cylinder includes an oil input/output port of the rodless chamber.

In certain embodiments, the second oil-adding passage may have a hydraulically controlled check valve. The hydraulically controlled check valve has (a) a first oil port connected to the rod chamber, (b) a second oil port connected to the rodless chamber, and (c) a control port connected to a third control oil passage positioned in the piston rod. In the first state, pressurized oil is pumped into the third control oil passage, and in the second state, the third control oil passage releases pressurized oil. In certain embodiments, the piston rod of the cylinder may further include a second oil input passage. The second oil input passage is in communication with an oil passage between the first oil port of the hydraulically controlled check valve and the rod chamber. The third control oil passage is further in communication with the rodless chamber.

In another aspect, the present disclosure relates to a compaction machine. The compaction machine has the cylinder driven lifting mechanism of the compaction machine described above.

These and other aspects of the present disclosure will become apparent from the following description of the preferred embodiment taken in conjunction with the following drawings, although variations and modifications therein may be effected without departing from the spirit and scope of the novel concepts of the invention.

BRIEF DESCRIPTION OF THE DRAWINGS

The accompanying drawings illustrate one or more embodiments of the invention and, together with the written description, serve to explain the principles of the invention. Wherever possible, the same reference numbers are used throughout the drawings to refer to the same or like elements of an embodiment. The drawings do not limit the present disclosure to the specific embodiments disclosed and described herein. The drawings are not necessarily to scale, emphasis instead being placed upon clearly illustrating the principles of the invention, and wherein.

DETAILED DESCRIPTION OF THE INVENTION

Figure 1:
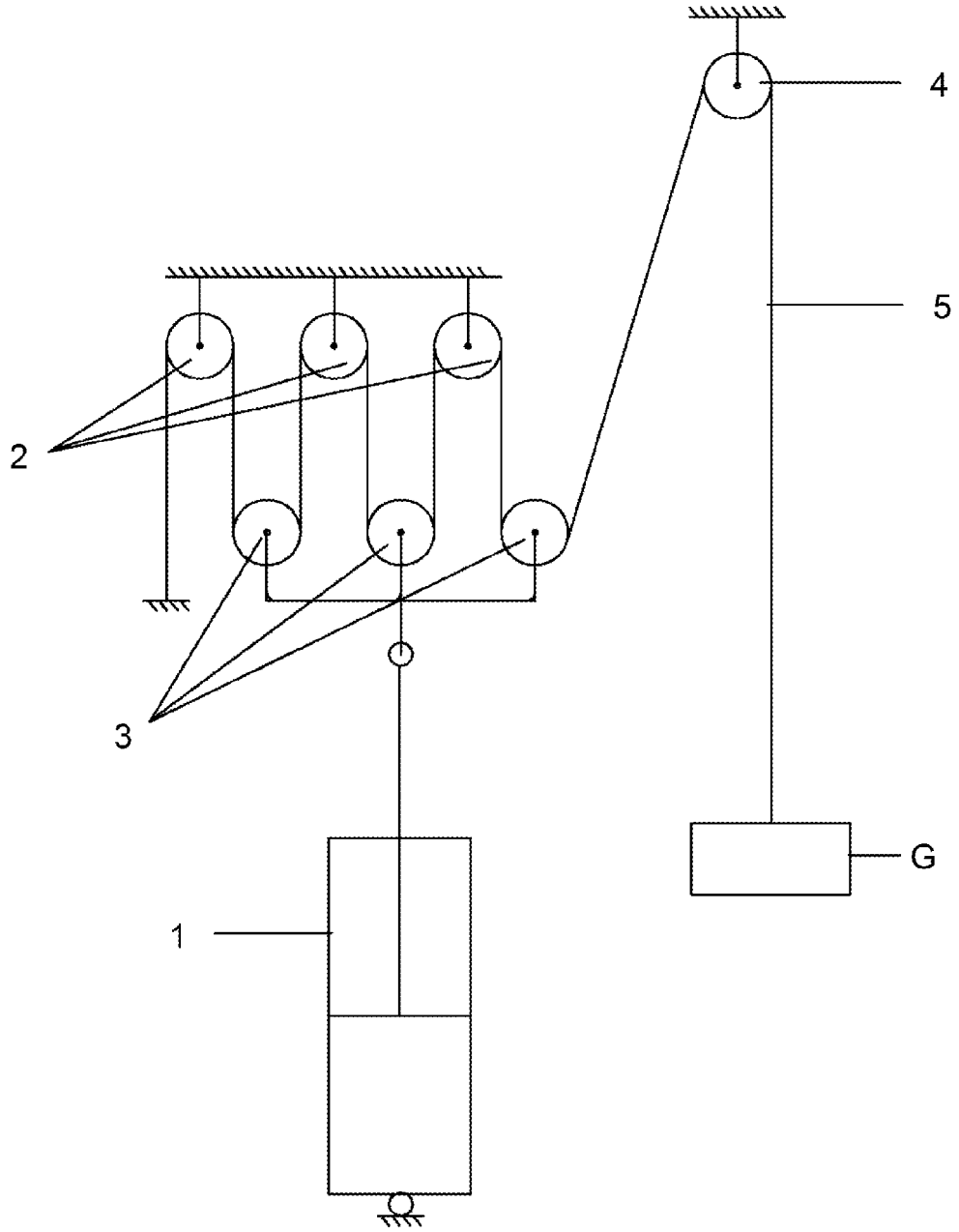
FIG. 1 is a schematic structural view of a lifting mechanism of a compaction machine according to one embodiment of the present disclosure.

The present disclosure will now be described more fully hereinafter with reference to the accompanying drawings, in which exemplary embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present disclosure.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including" or "has" and/or "having" when used herein, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom", "upper" or "top," and "front" or "back" may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

The description will be made as to the embodiments of the present disclosure in conjunction with the accompanying drawings. In accordance with the purposes of this invention, as embodied and broadly described herein, this invention, in one aspect, relates to a lifting mechanism of a compaction machine, and a compaction machine having the lifting mechanism of the compaction machine.

In one embodiment, a cylinder-driven lifting mechanism of the compaction machine is disclosed, and the cylinder-driven lifting mechanism of the compaction machine includes: (a) a cylinder, (b) a fixed pulley set, (c) a movable pulley set, and (d) a rope. The cylinder has a first end and a second end. The first end of the cylinder is connected to a vehicle body of the compaction machine, and the second end of the cylinder is connected to the movable pulley set. The rope has a head end, and a tail end. The tail end of the rope is connected a compaction hammer. The rope is wound on the fixed pulley set and the movable pulley set and is then connected to the compaction hammer. The cylinder is configured to perform extension and retraction movements. When the cylinder performs extension and retraction movements, the movable pulley set moves with the cylinder. The distance between the movable pulley set and the fixed pulley set increases or decreases accordingly, and then, the compaction hammer connected to the tail end of the rope is lifted up or dropped respectively.

FIG. 1 is a schematic structural view of a lifting mechanism of a compaction machine according to one embodiment of the present disclosure. The lifting mechanism of the compaction machine is used in a non-released-from-hook type compaction machine. During falling of a compaction hammer G, the compaction hammer G and (a rope 5 of) the lifting mechanism are in a connected state, so as to save additional time spend for lowering an empty hook of a released-from-hook type compaction machine and hooking. This non-released-from-hook type compaction machine improves construction efficiency.

Referring now to FIG. 1, a cylinder-driven lifting mechanism of a compaction machine is shown according to one embodiment of the present disclosure. The lifting mechanism of the compaction machine preferably includes: (a) a cylinder 1, (b) a fixed pulley set 2, (c) a movable pulley set 3, (d) a jib head guide pulley 4, and (e) a rope 5, and (f) a compaction hammer G. The rope 5 has two ends: a head end, and a tail end. The head end of the rope 5 is fixedly connected to a fixed point on a vehicle body (not shown in FIG. 1) of the compaction machine, and the tail end of the rope 5 is connected to the compaction hammer G. A first end of the cylinder 1 is connected to the vehicle body of the compaction machine, and a second end of the cylinder 1 is connected to the movable pulley set 3. It should be noted that the cylinder 1 has a piston and cylinder structure. In one embodiment, the first end of the cylinder 1 may be a piston rod end of the cylinder 1 and the second end of the cylinder 1 is the cylinder barrel. In another embodiment, the first end of the cylinder 1 may be a cylinder barrel end of the cylinder 1 and the second end of the cylinder 1 is the piston rod end of the cylinder 1. In the embodiment shown in FIG. 1, the piston rod end of the cylinder 1 is connected to the movable pulley set 3, and the cylinder barrel end of the cylinder 1 is connected to the vehicle body.

Figure 2:
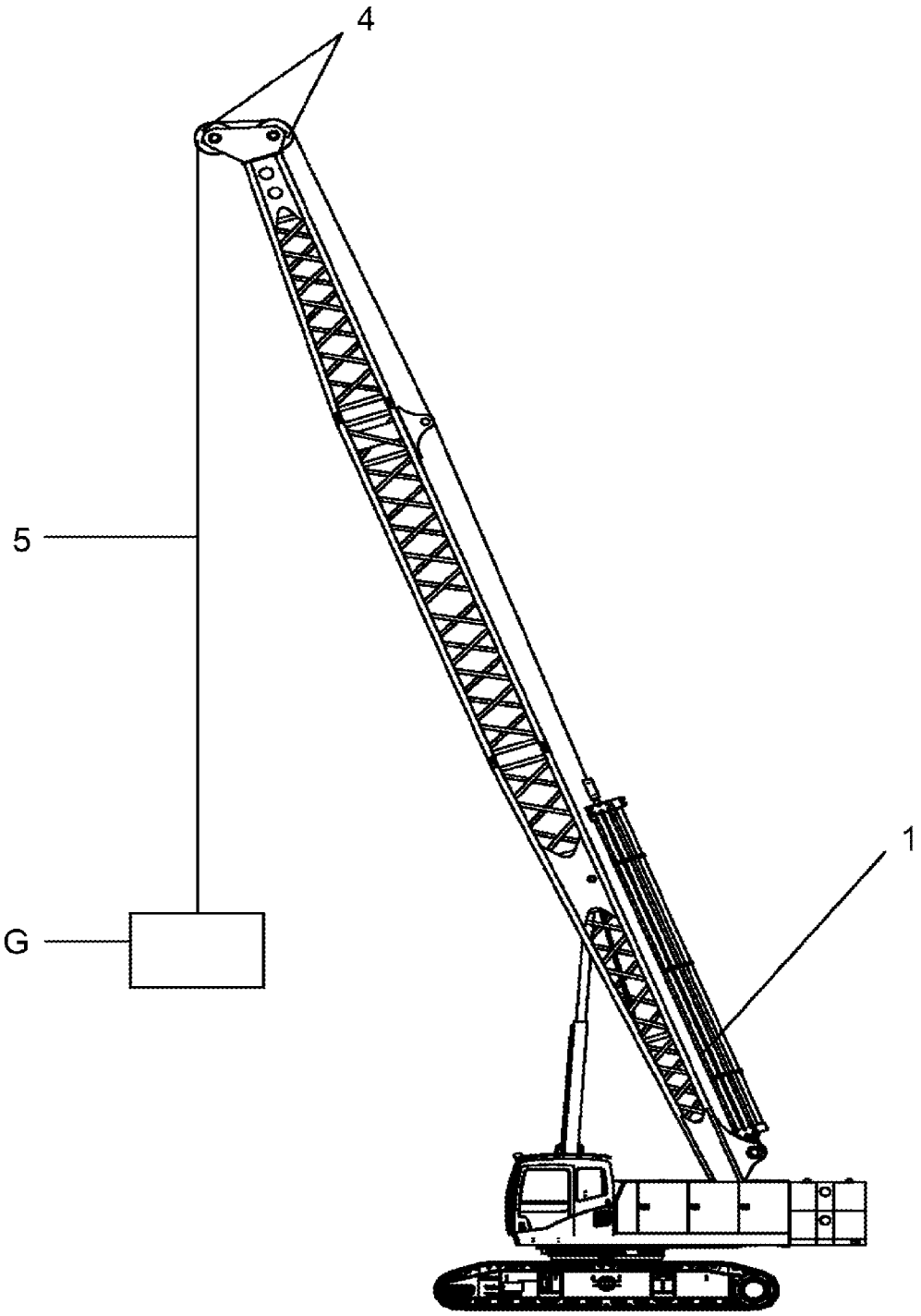
FIG. 2 is a schematic structural view of a compaction machine according to one embodiment of the present disclosure.
Figure 3:
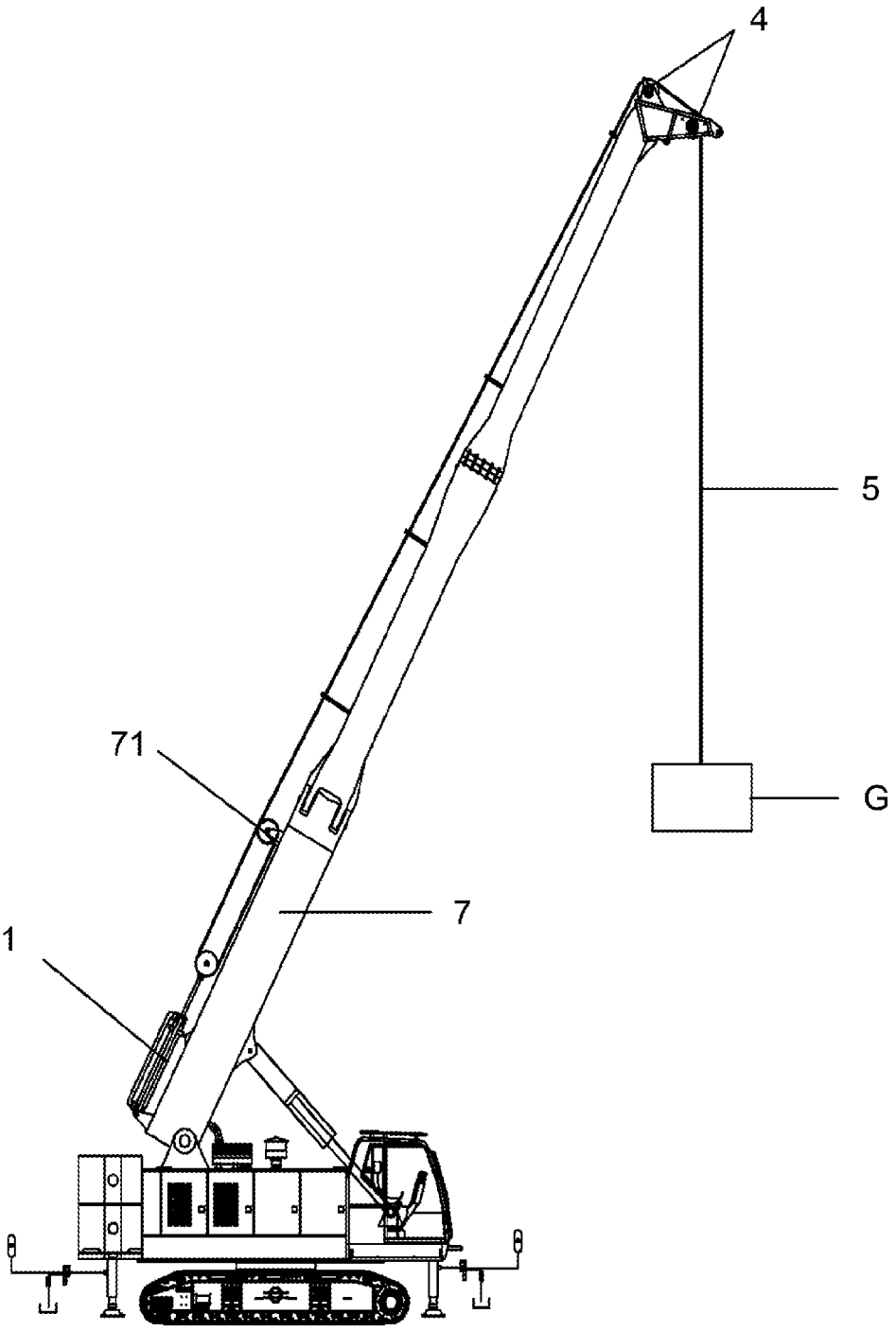
FIG. 3 is a schematic structural view of a compaction machine according to another embodiment of the present disclosure.

In one embodiment, the first end of the cylinder 1 may be connected to a platform of the compaction machine. In another embodiment, and the first end of the cylinder 1 may be connected to a jib 7 of the compaction machine (as shown in FIG. 2 and FIG. 3). The platform, the jib 7, and other parts, where the cylinder 1 may be mounted, of the compaction machine are all defined as the vehicle body of the present disclosure. The movable pulley set 3 is preferably connected to only one cylinder to avoid the problem that multiple cylinders require a coordinated movement of the movable pulley set 3.

In one embodiment, the second end of the cylinder 1 is connected to the movable pulley set 3. When the piston rod of the cylinder 1 extends or retracts, the movable pulley set 3 is driven by the piston rod of the cylinder 1, and moves with the piston rod of the cylinder 1. In a position shown in FIG. 1, the cylinder 1 performs extension and retraction movement vertically. When the cylinder 1 extends, the distance between the fixed point and the tip of the piston rod of cylinder 1 increases, and the movable pulley set 3 moves upwards and the distance between the movable pulley set 3 and the fixed pulley set 2 decreases, therefore, the compaction hammer G falls accordingly. When the cylinder 1 retracts, the distance between the fixed point and the tip of the piston rod of cylinder 1 decreases, and the movable pulley set 3 moves upwards and the distance between the movable pulley set 3 and the fixed pulley set 2 increases, therefore, the compaction hammer G is lifted up accordingly. In certain embodiments, the cylinder 1 may also perform extension and retraction movement in an oblique direction, as shown in FIG. 2 and FIG. 3.

In certain embodiments, the falling distance of the compaction hammer G generally ranges from 8 m to 25 m, and sometime reaches up to 40 m. Usually, the stroke distance of the piston rod of the cylinder 1 limits the falling distance of the compaction hammer G. In certain embodiments, the fixed pulley set 2 and the movable pulley set 3 are used here to multiply the stroke distance of the piston rod of the cylinder 1 so that the stroke of the piston rod of the cylinder 1 matches the falling distance of the compaction hammer G. When different configurations of the fixed and movable pulley sets are adopted, the stroke distance of the piston rod of the cylinder 1 are multiplied to yield greater falling distance of the compaction hammer G.

Referring now to FIGS. 2 and 3, in certain embodiments, the lifting mechanism of the compaction machine further includes the jib head guide pulley 4 in order to ensure a lifting height of the compaction hammer G. The jib head guide pulley 4 is positioned on a jib head at an end portion of the jib 7. The number of the jib head guide pulleys 4 may be set according to the structure of the jib head. In one embodiment, there is only one jib head guide pulley 4, as shown in FIG. 1. In another embodiment, there are two jib head guide pulley 4, as shown in FIGS. 2 and 3. Here, two jib head guide pulleys 4 are mounted on the tip of the jib 7, and the rope 5 is wound on the two jib head guide pulleys 4 sequentially. The jib head guide pulley 4 may also be replaced by other similar turning components.

In one embodiment, the rope 5 has its head end fixed. The rope 5 is wound on and turned on the fixed pulley set 2, the movable pulley set 3, and the jib head guide pulley 4, and has the tail end connected to the compaction hammer G. The rope 5 is wound on the fixed pulley set 2 and the movable pulley set 3, and is then preferably wound upwards on the jib head guide pulley 4, and turned to be connected downwards to the compaction hammer G. The foregoing "upwards" and "downwards" may be "vertically upwards" and "vertically downwards", and may also refer to a direction inclined by a certain angle from the vertical direction. In one embodiment, the rope 5 is a steel wire rope. In another embodiment, the rope 5 is an iron chain. In yet another embodiment, the rope 5 is a rope made of other flexible and strong materials.

In one embodiment, the fixed pulley set 2 may include one or more fixed pulleys, and similarly, the movable pulley set 3 may also include one or more movable pulleys. In order to increase the multiplication factor, the fixed pulley set 2 preferably includes multiple fixed pulleys, and the number of the movable pulleys of the movable pulley set 3 matches the number of the fixed pulleys. If the number of the fixed pulleys movable of the fixed pulley set 2 and the number of movable pulleys of the movable pulley set 3 are set as N, where N is an integer greater than 1, then the falling distance of the compaction hammer G is N times of the stroke distance of the piston rod of the cylinder 1.

In one embodiment, the number of the fixed pulleys and the number of the movable pulleys are both X, where X is an integer greater than 1. X is preferably 2, 3, or 4. The head end of the rope 5 is fixedly disposed, and the rope 5 is wound on the fixed pulleys and the movable pulleys alternately, and after being wound on the last movable pulley, is turned upwards to be wound on the jib head guide pulley 4. In the embodiment shown in FIG. 1, X=3, N=6, and the stroke distance of the piston rod of the cylinder 1 is kept in a reasonable range, such that the cylinder 1 becomes easy to produce, and manufacture, and install.

Figure 4:
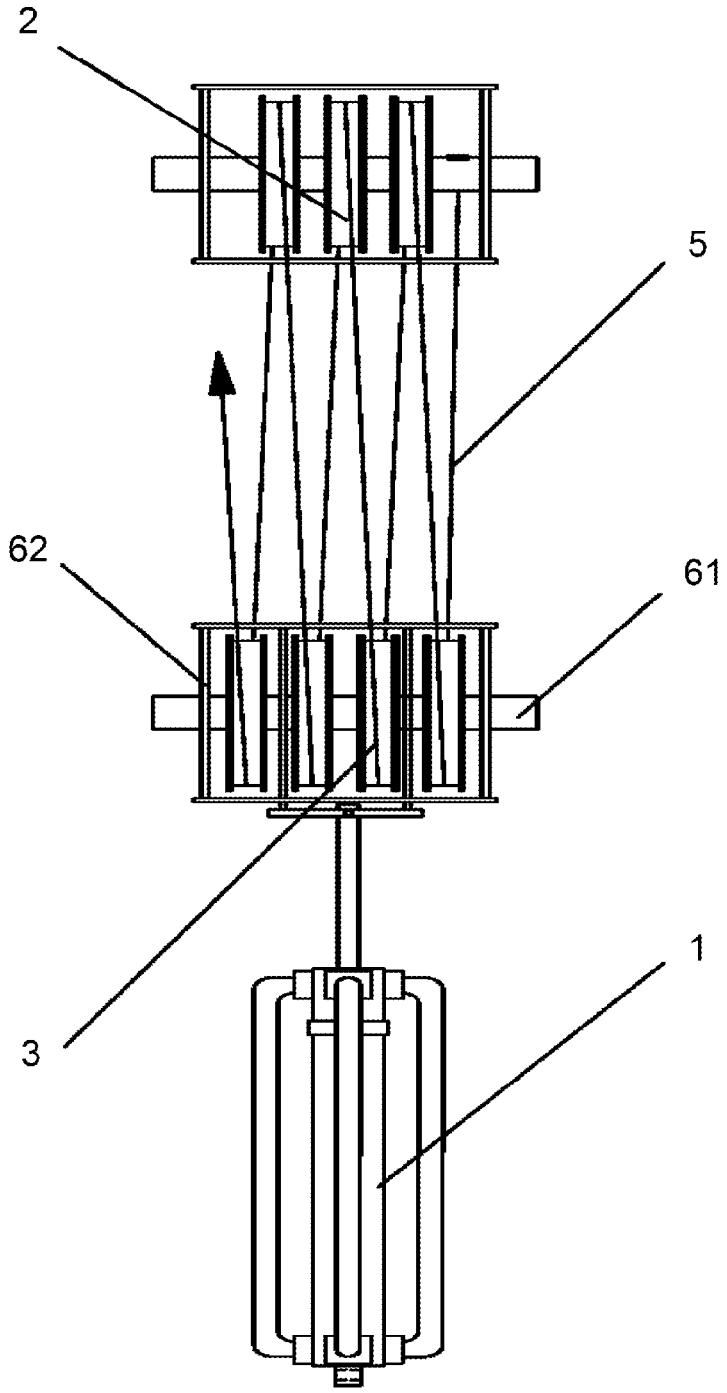
FIG. 4 is a schematic structural view of fixed and movable pulley sets of the compaction machine according to one embodiment of the present disclosure.

Referring now to FIG. 4, in another embodiment, the number of the fixed pulleys of the fixed pulley set 2 is Y, and the number of the movable pulleys of the movable pulley set 3 is Y+1, where Y is an integer greater than 1. Y is preferably 2, 3, or 4. The head end of the rope 5 is fixedly disposed, and after being wound on the first movable pulley, the rope 5 is wound on the other fixed pulleys and movable pulleys alternately, and after being wound on the last movable pulley, the rope 5 is turned upwards to be wound on the jib head guide pulley 4. In the embodiment shown in FIG. 4, Y=3, N=8, and similarly, the stroke distance of the piston rod of the cylinder 1 is also kept in a reasonable range.

When the compaction hammer G is moved up and down, each fixed pulley and movable pulley rotates accordingly, and the movable pulley set 3 travels with the movement of the piston rod of the cylinder 1. The movable pulley set 3 and the cylinder 1 may be connected by using different kinds of connecting components. In one embodiment, the movable pulleys may be mounted individually. In another embodiment, the movable pulleys may be mounted together in a movable pulley shaft. In one embodiment shown in FIG. 4, the movable pulleys are all mounted on a movable pulley mounting shaft 61, and rotate about an axis of the movable pulley mounting shaft 61. The movable pulley mounting shaft 61 is placed on a mounting support frame 62, and the second end of the cylinder 1 is connected to the mounting support frame 62. The direction in which the cylinder 1 performs extension and retraction movement is substantially perpendicular to the axial direction of the movable pulley mounting shaft 61.

In one embodiment, the piston rod of the cylinder 1 pushes and pulls the mounting support frame 62, and the movable pulley set 3 moves as a whole to change the distance between the movable pulley set 3 and the fixed pulley set 2 to move the compaction hammer G up or down. During the compaction hammer G movement, the travel direction of the rope 5 is predetermined to avoid shaking of the spool, reduce the damage to the components during the operation, and increase the reliability of the compaction machine.

In one embodiment, the jib 7 of the compaction machine has a truss structure (as shown in FIG. 2). In another embodiment, the jib 7 of the compaction machine has a box-like structure (as shown in FIG. 3). Both structures can achieve the technical effects of the lifting mechanism of the compaction machine with low manufacturing cost and desirable reliability. Based on the difference structures of the jib 7, the cylinder 1, the fixed pulley set 2, and the movable pulley set 3 may be located at different mounting positions.

In certain embodiments, the first end of the cylinder 1 is preferably disposed on the jib 7, and the cylinder 1 is disposed in parallel with the jib 7 to optimize the spatial layout and make the aesthetics of the overall appearance desirable. Further, a support 71 may further be mounted on the jib 7, and the fixed pulley set 2 is mounted on the support 71. Specific mounting manners of the components are not intended to limit the present disclosure.

In certain embodiments, the cylinder 1 may be placed on a vertically middle position of the jib 7. After the rope 5 is turned by the fixed pulley set 2 and the movable pulley set 3, releasing direction of the rope 5 is deviated from the middle position. Such deviation may be adjusted by changing the direction of the pulley to reduce a bias load and balance the force borne by the compaction machine.

In certain embodiments, the tail end of the rope 5 is connected to the compaction hammer G. The part of the rope 5, connected to the compaction hammer G, may likely be worn. If the length of the rope 5 is not adjustable, and when the tail end of the rope 5 is worn and fail, the entire rope may have to be replaced, which increases the use cost.

Figure 5A:
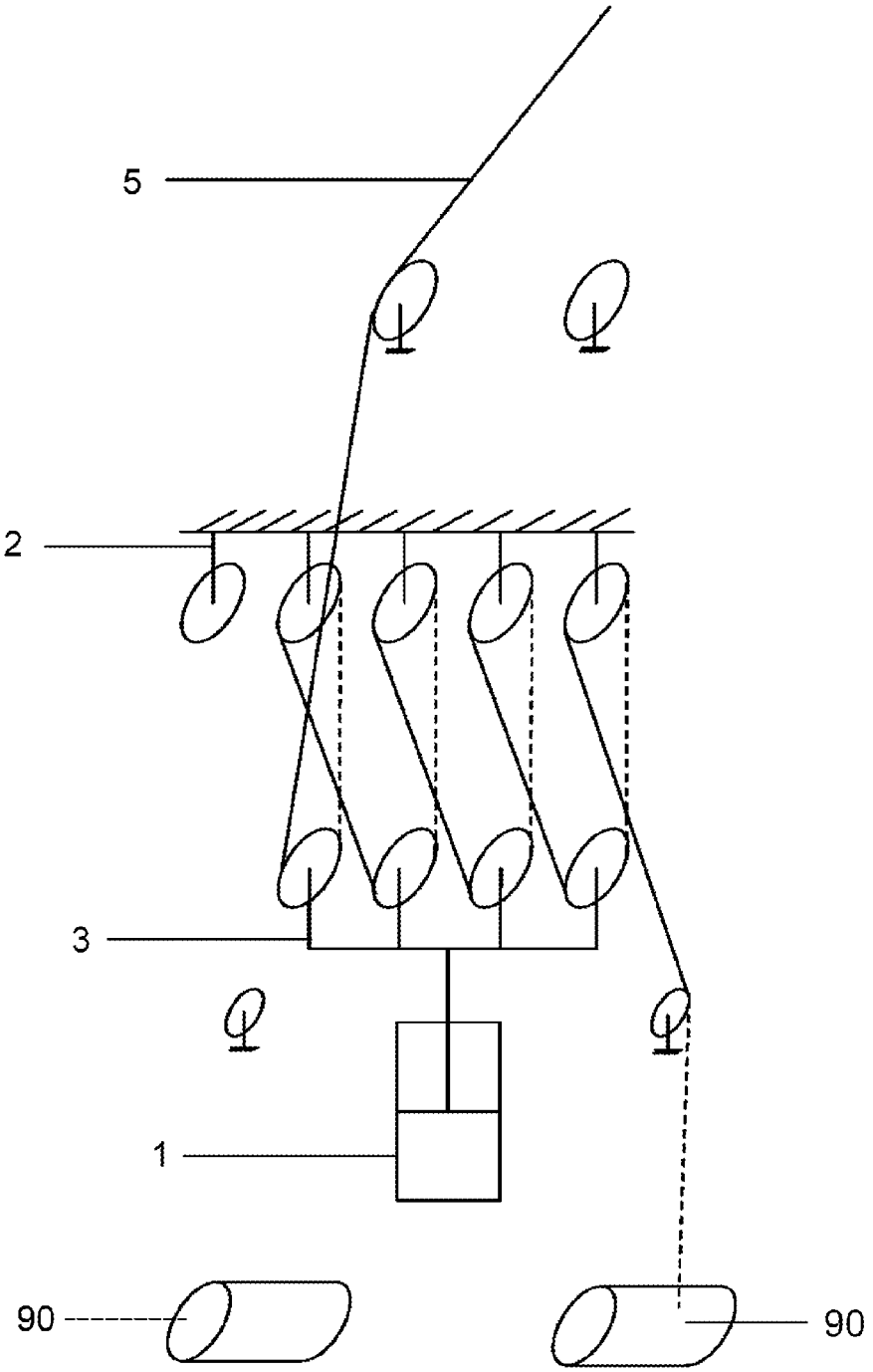
FIG. 5A is a schematic structural view of a single-rope releasing state according to one embodiment of the present disclosure.
Figure 5B:
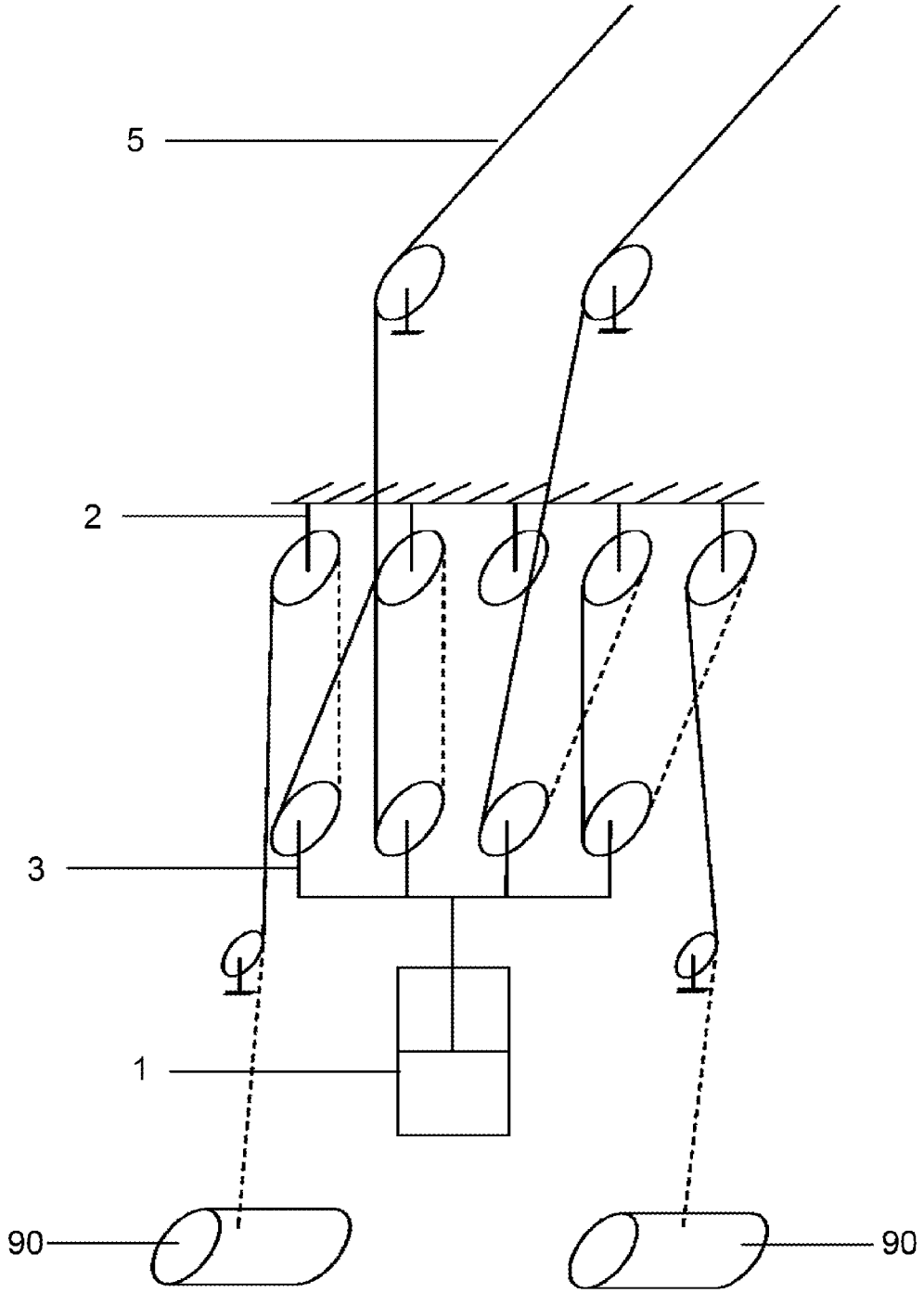
FIG. 5B is a schematic structural view of a dual-rope releasing state according to one embodiment of the present disclosure.

Referring now to FIGS. 5A and 5B, a technical solution where the released length of the rope can be adjusted is shown according certain embodiments of the present disclosure. A spool 90 is included, and is rotatably disposed on the vehicle body of the compaction machine. The head end of the rope 5 is fixed on the spool 90, and a part of the rope 5 is retractably wound on the spool 90. The spool 90 may be disposed on the platform of the compaction machine. In one embodiment, the spool 90 is manually rotated. In another embodiment, the spool 90 is driven by mechanisms such as a hydraulic motor. When the tail end of the rope 5 is worn, the worn part at the tail end may be cut, and the rope 5 wound on the spool 90 is released, so that the length of the part that is cut is compensated for, and the entire rope does not need to be replaced. The proper length of the rope 5 can be maintained and the use cost can be reduced.

In certain embodiments, during transportation of the compaction machine, the jib system of the compaction machine needs to be dismantled and transported separately. The rope 5 may be retracted into the spool 90 during the transportation. The spool 90 makes the retraction of the rope 5 very easy and convenient, and has desirable aesthetic arrangement.

In one embodiment, a single-rope releasing state of the lifting mechanism of the compaction machine is shown in FIG. 5A. In another embodiment, a dual-rope releasing state of the lifting mechanism of the compaction machine is shown in FIG. 5B. When the weight of a matching compaction hammer G in the single-rope releasing state is M (for example, 40 tons), the weight of a matching compaction hammer G in the dual-rope releasing state may reach 2M (for example, 80 tons), so that with the lifting height being the same, the compaction force may be doubled. Accordingly, the number of spools 90 disposed on the vehicle body is increased to 2. The number of the ropes 5 may be 1 for the single-rope releasing state, and 2 for the dual-rope releasing state respectively.

In the embodiment of the single-rope releasing state shown in FIG. 5A, the head end of the rope 5 is connected to one of the spools 90, the tail end of the rope 5 is connected to the compaction hammer G, and the other spool 90 is not used. The rope 5 is further wound on the fixed pulley set 2 and the movable pulley set 3, and the rope 5 may be turned through a guide pulley. In the state shown by this drawing, the number of the movable pulleys is 4, and N=8.

In the embodiment of the dual-rope releasing state shown in FIG. 5B, the head ends of two ropes 5 are each connected to one of the two spools 90, and the tail ends of the two ropes 5 are both connected to the compaction hammer G. Each rope 5 is further wound on the fixed pulley set 2 and the movable pulley set 3, and the rope 5 may be turned through a guide pulley. In the state shown in FIG. 5B, the number of the movable pulleys passed by each rope 5 is 2, and N=4. The two spools 90 may adjust the lengths of the ropes accordingly to maintain proper lengths and consistent actions of the two ropes such that the working reliability of the compaction machine is greatly improved.

In certain embodiment, the speed of the falling compaction hammer G is very high in the compaction operation. For example, if the compaction hammer G falls freely from the height of 20 m, the speed of the compaction hammer G can be as high as 18 meters/second when the compaction hammer G touches the ground, even if the factor of energy loss is taken into consideration. This fast compaction hammer travelling speed requires that the piston rod of the cylinder 1 to move quickly, and especially when the piston rod extends. Although the retraction speed of the piston rod of the cylinder 1 can be slow, but the extension speed has to be very high.

Figure 6:
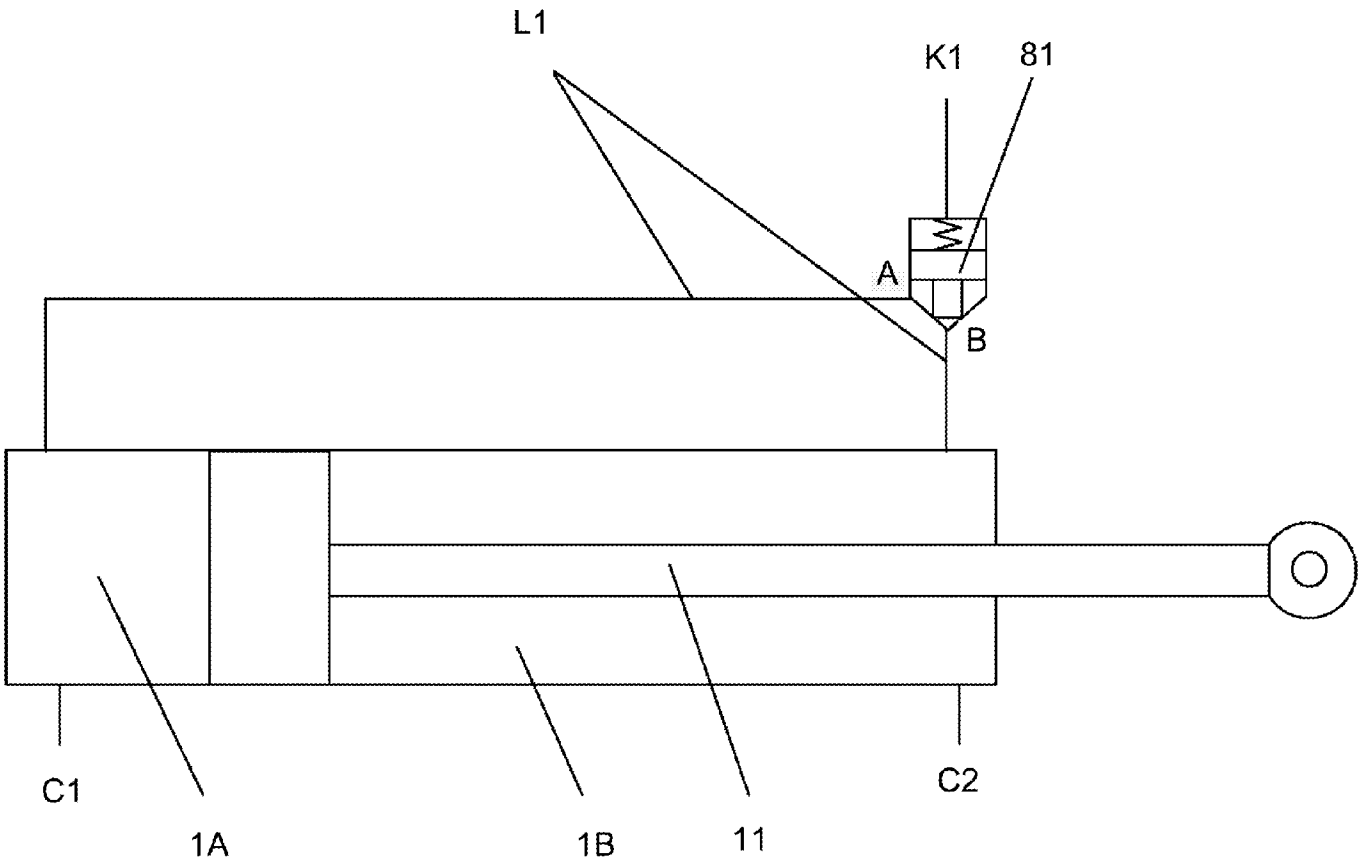
FIG. 6 is a schematic structural view of a cylinder according to one embodiment of the present disclosure.
Figure 7A:
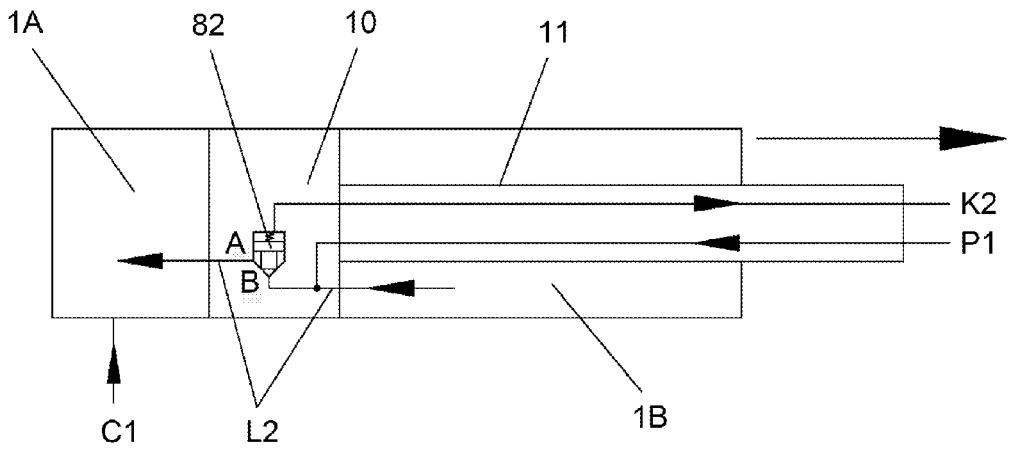
FIG. 7A is a schematic view of a cylinder in a first state according to one embodiment of the present disclosure.
Figure 7B:
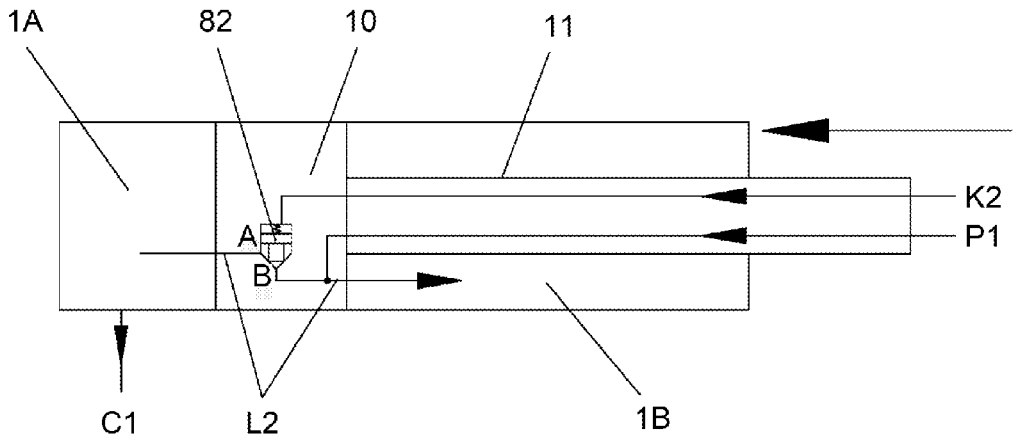
FIG. 7B is a schematic view of the cylinder in a second state according to the embodiment shown in FIG. 7A.
Figure 8A:
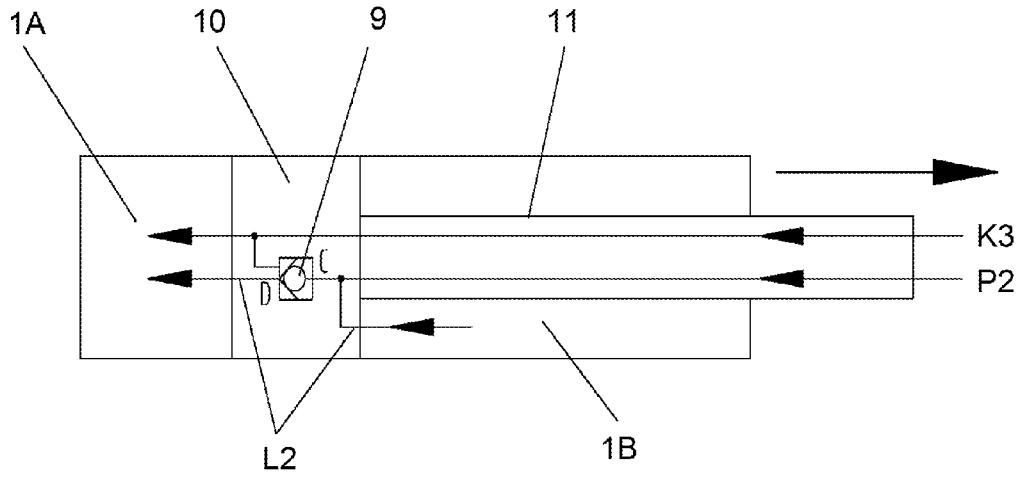
FIG. 8A is a schematic view of a cylinder in a first state according to one embodiment of the present disclosure.
Figure 8B:
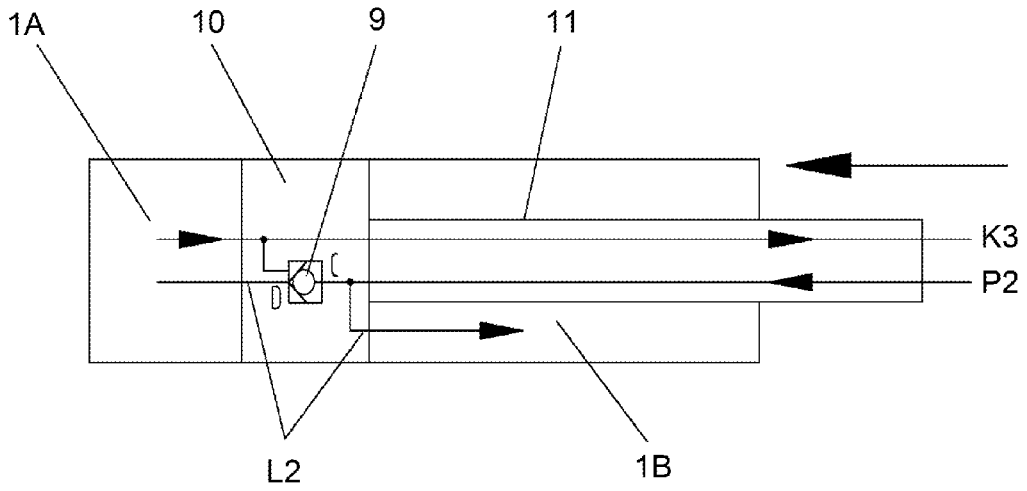
FIG. 8B is a schematic view of the cylinder in a second state according to the embodiment shown in FIG. 8A.

Referring now to FIGS. 6, 7A, 7B, 8A, and 8B, solutions regarding rapid extension of the piston rod of the cylinder 1 are shown according to certain embodiments of the present disclosure, so that the speed of movement of the piston rod of the cylinder 1 matches the speed of falling of the compaction hammer G to improve ramming efficiency. FIG. 6 is a schematic structural view of a cylinder 1 according to one embodiment of the present disclosure. FIGS. 7A-7B are schematic structural views of a cylinder 1 according to certain embodiments of the present disclosure. FIGS. 8A-8B are schematic structural views of a cylinder 1 according to certain embodiments of the present disclosure.

In the embodiment shown in FIG. 6, a first oil-adding passage L1 is placed outside of the cylinder barrel of the cylinder 1. In FIGS. 7A-7B and FIGS. 8A-8B, a second oil-adding passage L2 is provided in a piston 10 of the cylinder 1. It is understood that the technical effects of the present disclosure may also be realized by disposing oil-adding passages outside the cylinder barrel and in the piston of the cylinder 1 simultaneously.

The cylinder 1 has a piston 10 and a piston rod 11. The piston 10 divides the cylinder 1 into two chambers: a rodless chamber 1A and a rod chamber 1B. The chamber at the end of the piston 10 where piston rod connects to the piston 10 is referred as rod chamber 1B. The chamber at the opposite end of the piston 10 where piston rod connects to the piston 10 is referred as rodless chamber 1A. The first oil-adding passage L1 and the second oil-adding passage L2 are both connected to the rodless chamber 1A and the rod chamber 1B of the cylinder 1. Each of the first and second oil-adding passages is in either an opened state or a closed state. When each of the oil-adding passages is opened, the pressures at both ends of the piston 10 are equal. Since the pressure receiving area of an end surface of the piston 10 of the rodless chamber 1A is greater than that of the rod chamber 1B, the total pressures at the two ends of the piston 10 are different, and the piston 10 moves towards the rod chamber 1B, hydraulic oil in the rod chamber 1B enters the rodless chamber 1A through the oil-adding passage to increase the flow in the rodless chamber 1A to allow piston rod 11 to extend quickly.

In certain embodiments as shown in FIG. 6, when the piston rod 11 of the cylinder 1 extends (in a first state), the hydraulic oil enters from the rod chamber 1B through the first oil-adding passage L1 into the rodless chamber 1A, and the compaction hammer G falls.

The volume of the rodless chamber 1A is greater than the volume of the rod chamber 1A, so that oil needs to be further input through an oil input/output port C1 of the rodless chamber 1A to compensate for the hydraulic oil of the volume occupied by the piston rod 11. In this case, the flow of the oil input into the rodless chamber 1A is large, and the extension speed of the cylinder 1 is high.

When the piston rod 11 of the cylinder 1 retracts (in a second state), the first oil-adding passage L1 is closed, and the compaction hammer G is lifted up. In the second state, the first oil-adding passage L1 does not interfere with hydraulic oil exchange between the rod chamber 1B and the rodless chamber 1A. The hydraulic oil returns through the oil input/output port C1 of the rodless chamber 1A, and enters through an oil input/output port C2 of the rod chamber 1B. In this state, the compaction hammer G is lifted up, and there is no requirement for an increased speed of the movement of the piston rod 11 of the cylinder 1.

In certain embodiments, a first hydraulically controlled cartridge valve 81 may be provided to the first oil-adding passage L1. The first hydraulically controlled cartridge valve 81 includes a first port A, a second port B, a control port, and a path for a large hydraulic oil flow. In certain embodiments, the hydraulic oil flow can reach 3000 L/m. The first port A of the first hydraulically controlled cartridge valve 81 is connected to the rodless chamber 1A. The second port B of the first hydraulically controlled cartridge valve 81 is connected to the rod chamber 1B. The control port is connected to a first control oil passage K1. In the first state, the first control oil passage K1 releases the pressure. In the second state, pressure oil is pumped into the first control oil passage K1. Pressure releasing and oil entering states of the first control oil passage K1 may be achieved through a two-position-three-way reversing valve, and may also be achieved through other possible oil passage designs.

In certain embodiments, the lifting mechanism of the compaction machine has more than one first oil-adding passages L1. These first oil-adding passages L1 are disposed in parallel on an outer wall of the cylinder 1. The rodless chamber 1A and the rod chamber 1B are connected by these first oil-adding passages L1. Through combination of the flows of the multiple first oil-adding passages L1, the flow of the oil input into the rodless chamber 1A may reach 10000 L/m or more to ensure rapid extension of the piston rod 11, meeting requirement for a quick release of the compaction hammer G.

In the embodiments of the present disclosure shown in FIGS. 7A-7B and FIGS. 8A-8B, in the first state where the piston rod 11 of the cylinder 1 extends, the hydraulic oil enters from the rod chamber 1B through the second oil-adding passage L2 into the rodless chamber 1A, the compaction hammer G falls. The hydraulic oil exchange is performed inside the piston 10. In the second state when the piston rod 11 of the cylinder 1 retracts, the second oil-adding passage L2 is closed, and the compaction hammer G is lifted up.

In certain embodiments as shown in FIGS. 7A-7B, a second hydraulically controlled cartridge valve 82 may be provided to the second oil-adding passage L2. The second hydraulically controlled cartridge valve 82 includes a first port A, a second port B, and a control port, and a path for a large hydraulic oil flow. In certain embodiments, the flow can reach 1000 L/m. The first port A of the second hydraulically controlled cartridge valve 82 is connected to the rodless chamber 1A, and the second port B of the second hydraulically controlled cartridge valve 82 is connected to the rod chamber 1B. The control port is connected to a second control oil passage K2. The second control oil passage K2 is placed in the piston rod 11. In the first state, the second control oil passage K2 releases the pressure. In the second state, pressurized hydraulic oil is pumped into the second control oil passage K2. Pressure releasing and oil pumping states of the second control oil passage K2 may be achieved through a two-position-three-way reversing valve, and may also be achieved through other possible oil passage designs.

In certain embodiments, the piston rod 11 may further be provided with an oil passage to supply oil to the rod chamber 1B to optimize oil lines. Preferably, a first oil input passage P1 is further disposed in the piston rod 11 of the cylinder 1. The first oil input passage P1 is in communication with the oil passage between the second port B of the second hydraulically controlled cartridge valve 82 and the rod chamber 1B. The outer wall of the cylinder barrel of the cylinder 1 is further provided with the oil input/output port C1 of the rodless chamber 1A.

In the first state of the embodiment shown in FIG. 7A, the control port of the second hydraulically controlled cartridge valve 82 releases the pressure, and the second oil-adding passage L2 is opened. Oil entering into the rodless chamber 1A includes three parts: (a) oil enters through the oil input/output port C1 of the rodless chamber 1A, (b) oil enters through the first oil input passage P1 and the second hydraulically controlled cartridge valve 82, and (c) the hydraulic oil of the rod chamber 1B enters the rodless chamber 1A through the second hydraulically controlled cartridge valve 82. In this first state, the flow of the hydraulic oil into the rodless chamber 1A is large, and the extension speed of the cylinder 1 is high.

In the second state of the embodiment shown in FIG. 7B, oil enters into the control port of the second hydraulically controlled cartridge valve 82, and the second oil-adding passage L2 is closed. Oil returns through the oil input/output port C2 of the rodless chamber 1A, and oil enters into the rod chamber 1B through the first oil input passage P1. In this second state, the compaction hammer G is lifted up, and there is no requirement for an increased speed of the movement of the piston rod 11 of the cylinder 1.

In the embodiments shown in FIGS. 8A and 8B, a hydraulically controlled check valve 9 may be provided to the second oil-adding passage L2. The hydraulically controlled check valve 9 includes a first oil port C, a second oil port D, and a control port. When pressurized hydraulic oil enters into the control port, the hydraulically controlled check valve 9 is opened, and the hydraulic oil flows from the first oil port C to the second oil port D. The first oil port C of the hydraulically controlled check valve 9 is connected to the rod chamber 1B. The second oil port D of the hydraulically controlled check valve 9 is connected to the rodless chamber 1A. The control port of the hydraulically controlled check valve 9 is connected to a third control oil passage K3. The third control oil passage K3 is placed in the piston rod 11. In the first state, pressurized hydraulic oil enters into the third control oil passage K3. In the second state, the third control oil passage K3 releases the pressure. Pressure releasing and oil entering states of the third control oil passage K3 may be achieved through a two-position-three-way reversing valve, and may also be achieved through other possible oil passage designs.

In certain embodiments, the piston rod 11 may have an oil passage to supply oil to the rod chamber 1B to optimize oil lines. Preferably, the piston rod 11 of the cylinder 1 is further provided with a second oil input passage P2. The second oil input passage P2 is in communication with the oil passage between the first oil port C of the hydraulically controlled check valve 9 and the rod chamber 1B, and the third control oil passage K3 is further in communication with the rodless chamber 1A.

In the first state of the embodiment shown in FIG. 8A, hydraulic oil enters into the control port of the hydraulically controlled check valve 9, and the second oil-adding passage L2 is opened. Oil entering the rodless chamber 1A includes three parts: (a) oil enters through the second oil input passage P2, (b) oil enters through the third control oil passage K3, and (c) the hydraulic oil of the rod chamber 1B enters the rodless chamber 1A through the hydraulically controlled check valve 9. In this first state, the flow of the hydraulic oil into the rodless chamber 1A is large, and the extension speed of the piston rod 11 of the cylinder 1 is high.

In the second state of the embodiment shown in FIG. 8B, the control port of the second hydraulically controlled cartridge valve 82 releases the pressure, and the second oil-adding passage L2 is closed. Oil returns through the third control oil passage K3 of the rodless chamber 1A, and oil enters into the rod chamber 1B through the second oil input passage P2. In this second state, the compaction hammer G is lifted up, and there is no requirement for an increased speed of the movement of the piston rod 11 of the cylinder 1.

In certain embodiments, the present disclosure relates to a compaction machine that has the lifting mechanism of the compaction machine described above. Certain embodiments of the compaction machines are shown in FIG. 2 and FIG. 3.

In summary, the lifting mechanism of the compaction machine according to the present disclosure is significantly different from a conventional winch-type drive mechanism. It takes the advantage of the features: (a) a cylinder has a large driving force, and (b) the piston rod travelling distance can be multiplied by using the combination of a movable pulley set and a fixed pulley set. Additional advantages of the present disclosure include:

1) The lifting mechanism of the compaction machine is simple and convenient to maintain. A drive component of the lifting mechanism of the compaction machine according to the present disclosure is a hydraulic cylinder. It is simpler than a compaction machine with a winch-type drive mechanism. The winch-type drive mechanism requires components such as a motor, a speed reducer, and a brake. The drive component of the lifting mechanism of the compaction machine according to present disclosure has a simple structure, is easy to repair, and has lower production and manufacturing costs.
2) The occupied space is reasonable. According to the present disclosure, the cylinder 1 may be disposed on the jib structure of the compaction machine without occupying the space of the platform. The lifting mechanism of the compaction machine according to embodiments of the present disclosure does not require components that occupy large spaces, such as the motor, the reducer, and the spool. Overall layout of the compaction machine is more compact, and saves space.
3) The operation is smooth and highly reliable. According to the present disclosure, the cylinder 1 does not pull the rope 5 directly, the direction of movement of the cylinder 1 and the axis of the movable pulley set 3 has a perpendicular relationship therebetween; during lifting or falling of the compaction hammer G, the travel direction of the rope 5 is fixed and a single one, shaking of the spool caused by inclination in the prior art does not occur, damage to the components during the operation is small, and the advantage of high reliability is achieved.
4) The compaction energy loss is small. In one embodiment, an oil-adding passage is placed outside of the cylinder barrel of the cylinder. In another embodiment, an oil-adding passage is placed in the piston. The hydraulic oil in the rod chamber 1B can rapidly enter the rodless chamber 1A through the oil-adding passage to ensure sufficient movement speed of the piston rod of the cylinder. The multiplying factor between the falling distance of the compaction hammer G and the stroke distance of the piston rod of the cylinder may be adjusted through the fixed and movable pulley sets, so that the speed of movement of the cylinder 1 matches the speed of falling of the compaction hammer G, so as to decrease the loss of the compaction energy in non-released-from-hook working conditions and to improve ramming efficiency.

Therefore, the beneficial effects of the present disclosure are obvious.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present disclosure pertains without departing from its spirit and scope. Accordingly, the scope of the present disclosure is defined by the appended claims, the foregoing description and the exemplary embodiments described therein, and accompanying drawings.

What is claimed is:

1. A cylinder-driven lifting mechanism of a compaction machine, comprising:

a cylinder having a first end and a second end;

a fixed pulley set;

a movable pulley set; and a rope having a head end, and a tail end configured to connect a compaction hammer;

wherein the first end of the cylinder is connected to a vehicle body of the compaction machine, the second end of the cylinder is connected to the movable pulley set, the rope is wound on the fixed pulley set and the movable pulley set and is then connected to the compaction hammer, and when the cylinder performs extension and retraction movement, the movable pulley set moves with the cylinder, the distance between the movable pulley set and the fixed pulley set increases or decreases, and the compaction hammer connected to the tail end of the rope is lifted up or dropped respectively; and wherein a first oil-adding passage is further disposed outside a cylinder barrel of the cylinder, and the first oil-adding passage is connected to a rodless chamber and a rod chamber of the cylinder, and in a first state when a piston rod of the cylinder extends, hydraulic oil enters from the rod chamber through the first oil-adding passage into the rodless chamber, and the compaction hammer falls; in a second state when the piston rod of the cylinder retracts, the first oil-adding passage is closed, and the compaction hammer is lifted up.

2. The lifting mechanism of the compaction machine according to claim 1, further comprising a jib head guide pulley positioned on a jib of the compaction machine, wherein the rope is wound upwards on the jib head guide pulley, and then turned downwards to connect to the compaction hammer.

3. The lifting mechanism of the compaction machine according to claim 2, wherein the number of fixed pulleys of the fixed pulley set and the number of movable pulleys of the movable pulley set are both X, and X is an integer greater than 1, the head end of the rope is fixedly disposed, and the rope is wound on the fixed pulleys and the movable pulleys alternately, and is turned upwards to go through the jib head guide pulley after being wound on the last movable pulley.

4. The lifting mechanism of the compaction machine according to claim 2, wherein the number of fixed pulleys of the fixed pulley set is Y, the number of movable pulleys of the movable pulley set is Y+1, Y is an integer greater than 1, the head end of the rope is fixedly disposed, and the rope is wound on the first movable pulley, is then wound on the fixed pulleys and movable pulleys alternately, and is turned upwards to go through the jib head guide pulley after being wound on the last movable pulley.

5. The lifting mechanism of the compaction machine according to claim 1, wherein movable pulleys of the movable pulley set are all positioned on a mounting shaft, and rotate about an axis of the mounting shaft, the mounting shaft is mounted on a mounting support frame, and the second end of the cylinder is connected to the mounting support frame.

6. The lifting mechanism of the compaction machine according to claim 1, wherein the jib of the compaction machine is of a box-like structure or a truss structure, the first end of the cylinder is positioned on the jib, and the cylinder is positioned to be in parallel with the jib.

7. The lifting mechanism of the compaction machine according to claim 6, wherein a support is mounted on the jib, and the fixed pulley set is mounted on the support.

8. The lifting mechanism of the compaction machine according to claim 1, further comprising a spool rotatably mounted on the vehicle body, the head end of the rope is fixed on the spool, and a part of the rope is retractably wound on the spool.

9. The lifting mechanism of the compaction machine according to claim 8, wherein the number of the spools is 2, the number of the ropes is 1 for a single-rope releasing state wherein the head end of the rope is connected to one of the spools, and the tail end of the rope is connected to the compaction hammer.

10. The lifting mechanism of the compaction machine according to claim 8, wherein the number of the spools is 2, the number of the ropes is 2 for a dual-rope releasing state wherein the head ends of the two ropes are each connected to a spool, and the tail ends of the two ropes are both connected to the compaction hammer.

11. The lifting mechanism of the compaction machine according to claim 1, wherein the movable pulley set is connected to only one cylinder.

12. The lifting mechanism of the compaction machine according to claim 1, wherein the first oil-adding passage comprises a first hydraulically controlled cartridge valve, and wherein the first hydraulically controlled cartridge valve comprises:

a first port connected to the rodless chamber;

a second port connected to the rod chamber; and a control port connected to a first control oil passage;

wherein in the first state, the first control oil passage releases pressurized oil; and in the second state, pressurized oil is pumped into the first control oil passage.

13. The lifting mechanism of the compaction machine according to claim 1, further comprising a plurality of first oil-adding passages mounted in parallel on an outer wall of the cylinder, and configured to connect the rodless chamber and the rod chamber.

14. A compaction machine comprising the lifting mechanism of the compaction machine according to claim 1.

15. A cylinder-driven lifting mechanism of a compaction machine, comprising:

a cylinder having a first end and a second end;

a fixed pulley set;

a movable pulley set; and a rope having a head end, and a tail end configured to connect a compaction hammer;

wherein the first end of the cylinder is connected to a vehicle body of the compaction machine, the second end of the cylinder is connected to the movable pulley set, the rope is wound on the fixed pulley set and the movable pulley set and is then connected to the compaction hammer, and when the cylinder performs extension and retraction movement, the movable pulley set moves with the cylinder, the distance between the movable pulley set and the fixed pulley set increases or decreases, and the compaction hammer connected to the tail end of the rope is lifted up or dropped respectively; and wherein a second oil-adding passage is positioned in a piston of the cylinder, and the second oil-adding passage connects to a rodless chamber at one end of the piston and a rod chamber at the other end of the piston;

and in a first state when the piston rod of the cylinder extends, hydraulic oil enters from the rod chamber through the second oil-adding passage into the rodless chamber such that the compaction hammer falls; in a second state when the piston rod of the cylinder retracts, the second oil-adding passage is closed, and the compaction hammer is lifted up.

16. The lifting mechanism of the compaction machine according to claim 15, wherein the second oil-adding passage comprises a second hydraulically controlled cartridge valve having a first port connected to the rodless chamber, a second port connected to the rod chamber, and a control port connected to a second control oil passage, wherein the second control oil passage is positioned in the piston rod; in the first state, the second control oil passage releases pressurized oil, and in the second state, pressurized oil is pumped into the second control oil passage.

17. The lifting mechanism of the compaction machine according to claim 16, wherein a first oil input passage is further disposed in the piston rod of the cylinder, the first oil input passage is in communication with an oil passage between the second port of the second hydraulically controlled cartridge valve and the rod chamber, and the outer wall of the cylinder barrel of the cylinder comprises an oil input/output port of the rodless chamber.

18. The lifting mechanism of the compaction machine according to claim 15, wherein the second oil-adding passage comprises a hydraulically controlled check valve having a first oil port connected to the rod chamber, a second oil port connected to the rodless chamber, and a control port connected to a third control oil passage positioned in the piston rod; and in the first state, pressurized oil is pumped into the third control oil passage; in the second state, the third control oil passage releases pressurized oil.

19. The lifting mechanism of the compaction machine according to claim 18, wherein the piston rod of the cylinder further comprises a second oil input passage that is in communication with an oil passage between the first oil port of the hydraulically controlled check valve and the rod chamber, and the third control oil passage is further in communication with the rodless chamber.

20. A compaction machine comprising the lifting mechanism of the compaction machine according to claim 15.

* * * * *